US011435069B2

(12) United States Patent
Künzler

(10) Patent No.: US 11,435,069 B2
(45) Date of Patent: Sep. 6, 2022

(54) ILLUMINATION CHAIN

(71) Applicant: GLP German Light Products GmbH, Karlsbad (DE)

(72) Inventor: Udo Künzler, Karlsbad (DE)

(73) Assignee: GLP GERMAN LIGHT PRODUCTS GMBH, Karlsbad (DE)

( * ) Notice: Subject to any disclaimer, the term of this patent is extended or adjusted under 35 U.S.C. 154(b) by 0 days.

(21) Appl. No.: 17/406,308

(22) Filed: Aug. 19, 2021

(65) Prior Publication Data

US 2021/0381679 A1 Dec. 9, 2021

Related U.S. Application Data

(63) Continuation of application No. PCT/EP2020/054923, filed on Feb. 25, 2020.

(30) Foreign Application Priority Data

Feb. 26, 2019 (DE) ..... 10 2019 202 555.2

(51) Int. Cl.

| | |
|---|---|
| ***F21V 21/26*** | (2006.01) |
| ***F21S 4/28*** | (2016.01) |
| ***F21K 9/20*** | (2016.01) |
| ***F21V 23/06*** | (2006.01) |

(52) U.S. Cl.

CPC ..... *F21V 21/26* (2013.01); *F21K 9/20* (2016.08); *F21S 4/28* (2016.01); *F21V 23/06* (2013.01)

(58) Field of Classification Search

CPC ..... F21V 21/26; F21V 21/30; F21V 23/06; F21S 4/28; F21S 4/20; F21K 9/20

See application file for complete search history.

(56) References Cited

U.S. PATENT DOCUMENTS

| | | | |
|---|---|---|---|
| 2015/0117005 | A1 | 4/2015 | Zanotto et al. |
| 2018/0356055 | A1 | 12/2018 | Magielse et al. |

FOREIGN PATENT DOCUMENTS

| | | | | |
|---|---|---|---|---|
| CN | 104948970 | A | 9/2015 | |
| CN | 205137137 | U | 4/2016 | |
| CN | 205619063 | U | 10/2016 | |
| CN | 106813128 | A | 6/2017 | |
| CN | 207378634 | U | 5/2018 | |
| DE | 20 2008 012 394 | U1 | 11/2008 | |
| DE | 20 2014 104 847 | U1 | 12/2014 | |
| DE | 10 2016 012 600 | A1 | 4/2018 | |
| EP | 1 463 906 | B1 | 7/2006 | |
| FR | 692 318 | A | 11/1930 | |
| JP | 2011-090887 | A | 5/2011 | |
| WO | WO-2013174929 | A1 * | 11/2013 | ..... F21K 9/20 |

OTHER PUBLICATIONS

International Search Report and Written Opinion issued in application No. PCT/EP2020/054923.

* cited by examiner

*Primary Examiner* — Anabel Ton

(74) *Attorney, Agent, or Firm* — McClure, Qualey & Rodack, LLP

(57) ABSTRACT

An illumination chain includes a first illumination element and a multitude of further illumination elements, wherein each further illumination element is connected via a joint each to the preceding illumination element.

10 Claims, 4 Drawing Sheets

ILLUMINATION CHAIN

CROSS-REFERENCES TO RELATED APPLICATIONS

This application is a continuation of copending International Application No. PCT/EP2020/054923, filed Feb. 25, 2020, which is incorporated herein by reference in its entirety, and additionally claims priority from German Application No. DE 10 2019 202 555.2, filed Feb. 26, 2019, which is incorporated herein by reference in its entirety.

Embodiments of the present invention relate to an illumination chain, in particular to an illumination chain with flexible joints.

BACKGROUND OF THE INVENTION

There are different variants of illumination chains. Regular fields of application are the illumination of Christmas trees or the lighting of contours, e.g. for the purpose of decoration. here, so-called LED tubes have established themselves in the last years. In addition, so-called LED bands containing a multitude of LEDs in series on a flexible carrier are known. All of these illumination chains have in common that they only offer a type of illumination in the sense of "being seen" and not in the sense of lighting.

In addition, further prior art is known. CN 106813128 A shows an illumination element with a longitudinal base shape. In addition, reference is also made to CN 205137137 U and JP 2011090887 A, both showing longitudinal illumination elements.

US 20150117005 A1, DE 202014104847 U1, and CN 207378634 U form further prior art.

Illumination elements for lighting are available in the form of spotlights.

SUMMARY

According to an embodiment, an illumination chain may have: a first illumination element; and a multitude of further illumination elements, wherein each further illumination element is connected via a joint to the preceding illumination element; wherein each illumination element comprises optics configured to emit light in an emission direction; and wherein each illumination element comprises an emission direction, and wherein all emission directions of all illumination elements are orientated equally; wherein each illumination element comprises LED illuminants; wherein the joint is realized by a connector belonging to the illumination element and extending beyond a round base shape of the illumination element, in connection with an engagement portion of the further illumination element connected to the illumination element, wherein the LED illuminant is embedded into the round base shape of the illumination element, wherein the engagement portion comprises a slit extending at an angle along a circumference of the round base shape of the illumination element, wherein a projection of the connector is introduced into the slit and is guided rotationally.

According to another embodiment, a system may have a first and second illumination chain according to the invention, connected with each other so as to create a row of the illumination elements of the first and second illumination chains.

According to another embodiment, a system may have a first and second illumination chain according to the invention, connected to each other so that the first and the second illumination chains form an illumination surface.

Embodiments of the present invention provide an illumination chain with a first illumination element and a plurality of further illumination elements, wherein each further illumination elements is connected via a joint to the preceding illumination element (with the first illumination element when considering the first further illumination element, or with a preceding further illumination element when considering one of the rear illumination elements). The joints may comprise means (or device) to carry a current.

According to embodiments, the joints are separable and connectable so that the means to carry a current is essentially realized by contact elements. With respect to the joints, it is to be noted that they are advantageously rotational joints, e.g., that limit 3, 4, or 5 degrees of freedom. For example, when assuming 5 degrees of freedom, rotational movement is still possible, so to speak. According to embodiments, each illumination element has its own emission direction, wherein all emission directions are essentially oriented equally, i.e. they extend in parallel. The joints are implemented such that the one degree of freedom that is still free enables a rotation such that the emission direction is not changed. Thus, the rotation direction of the rotational joints is parallel to the emission direction. As already explained above, the illumination elements advantageously comprise LED illuminants, such as RGB illuminants, operated by a corresponding control/current supply. According to embodiments, these electronics may be provided in the first illumination element, e.g., for all illuminants of the illumination elements. Alternatively, it would also be conceivable that each illumination element includes its own electronics, or current supply (its own power connection). Advantageously, the current is fed in via the first illumination element and is then distributed across the chain through the joints.

According to embodiments, the joints are implemented such that there may be a connection and a separation. In this case, it is advantageous that the chain is extendable, either by coupling further illumination elements, or by coupling a further illumination chain. This connection means (or device) may be integrated into the joint, for example. In particular, the first illumination element is configured to be coupled with a further illumination element or a further first illumination element. The connection with a further first illumination element may be implemented such that the two chains then extend in parallel. Assuming several of these illumination chains extending in parallel, such an arrangement may provide a curtain.

Thus, a further embodiment provides a system with a first and a second illumination chain, e.g., connected in series or connected such that the two illumination chains form an illumination surface.

DETAILED DESCRIPTION OF THE INVENTION

Figure 1A:
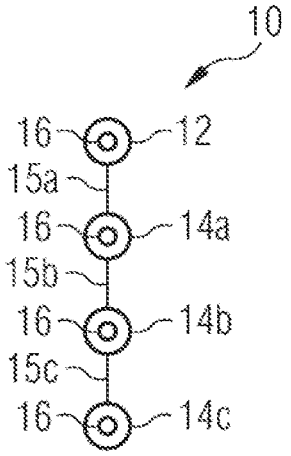
FIG. 1*a* shows a schematic illustration of an illumination chain according to a base embodiment.

Before subsequently explaining embodiments of the present invention on the basis of the accompanying drawings, it is to be noted that elements and structures having the same effects are provided with the same reference numerals so that their description is applicable to each other.

FIG. 1*a* shows an illumination chain 10 with a first illumination element 12 and further illumination elements 14*a* to 14*c*. For example, each illumination element 12 to 14*c* has an illuminant such as a LED or a RGB LED (cf. reference numeral 16). All illuminants 16 comprise an emission direction, wherein the emission directions of the illuminants 16 of the illumination elements 12 to 14*c* are advantageously orientated equally (i.e. in parallel with an emission in the same direction).

The illumination elements 12, 14*a*, 14*b* and 14*c* are arranged in series and are connected via connection regions 15*a* to 15*c*. The connection element 15*a* connects the illumination element 14*a* to the illumination element 12, the connection element 15*b* connects the illumination element 14*b* to the illumination element 14*a*, the connection element 15*c* connects the illumination element 14*c* to the illumination element 14*b*, etc. The connections 15*a*, 15*b*, and 15*c* are implemented in a jointed way.

For example, the joint mechanism may be implemented such that each round illumination element 12-14*c* has a reception for a ridge 15*a* to 15*c* that may be implemented rotationally around the round illumination element 12 to 14*c*, wherein the ridge 15*a* to 15*c* is fixedly coupled to the respective illumination element 14*a* to 14*c*. The connection elements 15*a* to 15*c*, or the joints, each include means to carry a current so that a current fed into the first illumination element 12 may be distributed to the further illumination elements. According to further embodiments, it is to be noted that the connection elements are separable and connectable so that the entire system may also be used in a flexible way. With respect to the joints, it is to be noted that, according to a variation, all but one degree of freedom are limited, wherein, according to other embodiments, the joints are orientated with respect to each other so that all their rotation axes extend in parallel. The axes may also be located in parallel to the rotation axes of the joints. The purpose of this is, assuming that all illumination elements comprise lighting elements with a specified emission direction (the emission direction of all illumination elements being orientated equally), that the emission takes place in one direction regardless of which position the joint is currently in.

The illumination chain arranged in a straight line FIG. 1*a* may be arranged differently.

Figure 1B:
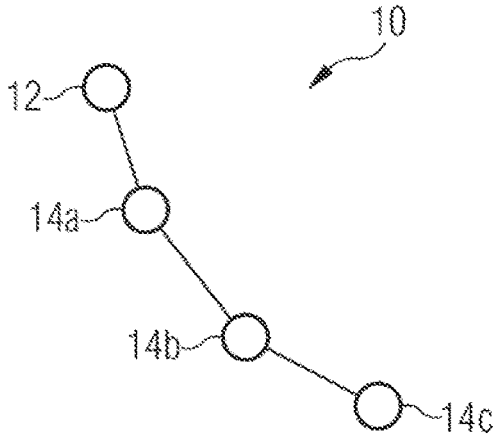
FIGS. 1*b* to 1*c* show schematic illustrations of possible positions of the joints of the illumination chain of FIG. 1*a* according to embodiments.
Figure 1C:
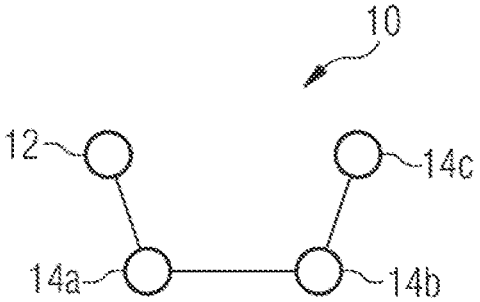

As becomes obvious from FIGS. 1*b* and 1*c*, such significant changes of joint positions are not really required. The two illustrations show two different instances of an arc-shaped arrangement of the illumination chain 10.

For example, in order to concentrate the luminosity, a diamond-shaped arrangement would be possible by shifting the illumination elements 12-14*c* amongst themselves (cf. FIG. 1*c*). In this case, only the illumination elements 12-14*c* that allow a corresponding angular range (of at least 25 degrees, advantageously at least 90 degrees, or here even at least 270 degrees) are twisted.

According to embodiments, the number of illumination elements is not reduced to four (1+3), but may vary accordingly, e.g. three elements or even more than four elements in total. For example, this may be realized by the individual elements being connectable to each other so that the number of individual elements may be varied. According to a further variant, two illumination chains 10 and 10' may be connected to each other, as is exemplarily shown in FIG. 2*a*.

Figure 2A:
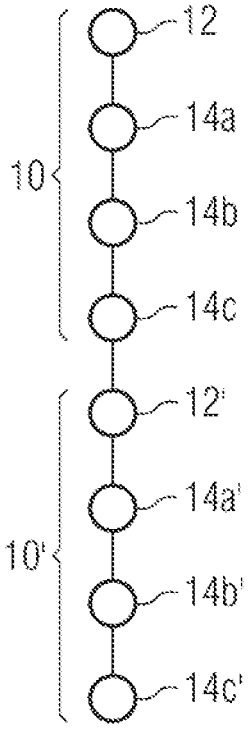
FIGS. 2*a* and 2*b* show schematic illustrations of two or more combined illumination chains according to further embodiments.

FIG. 2*a* shows a first illumination chain 10 having coupled thereto a second illumination chain 10' comparable to the first illumination chain 10. In this case, the first illumination element 12' of the second illumination chain 10' is connected to the last illumination element 14*c* of the first illumination chain 10. For this process, a multitude of illumination chains is connectable to each other. It is to be noted that, in order to connect several illumination chains to each other, the respectively first illumination element is configured such that it may be connected to a further illumination element.

Figure 2B:
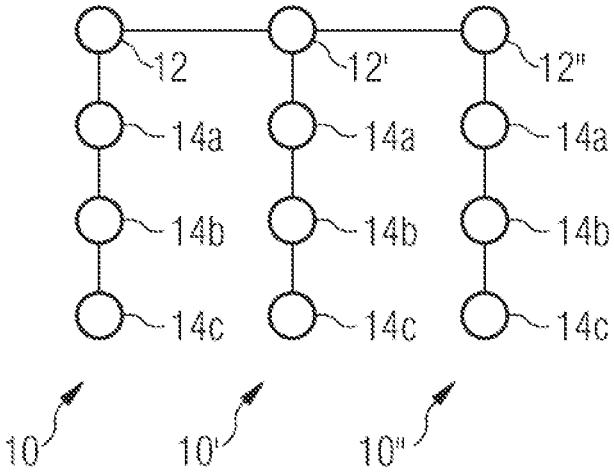

According to further embodiments, the first illumination element may also be implemented such that it may be connected to a further first illumination element, as subsequently explained with reference to FIG. 2*b*. In FIG. 2*b*, three illumination chains 10, 10' and 10" are arranged next to each other. In this case, the respectively first illumination elements 12, 12' and 12" are each connected to each other, e.g. at an angle of 90 degrees (a general range of between 75 and 105 degrees, or 60 to 120 degrees) with respect to the further illumination element 14*a*, 14*a'* or 14*a"*, respectively. For example, the respective chains 10, 10' and 10" may extend longitudinally so that they extend in parallel, or essentially parallel, with respect to each other and so that an illumination surface is spanned by the three illumination chains 10, 10', 10".

There are different realization variants for the joints, wherein one realization variant is explained with reference to FIG. 3.

Figure 3:
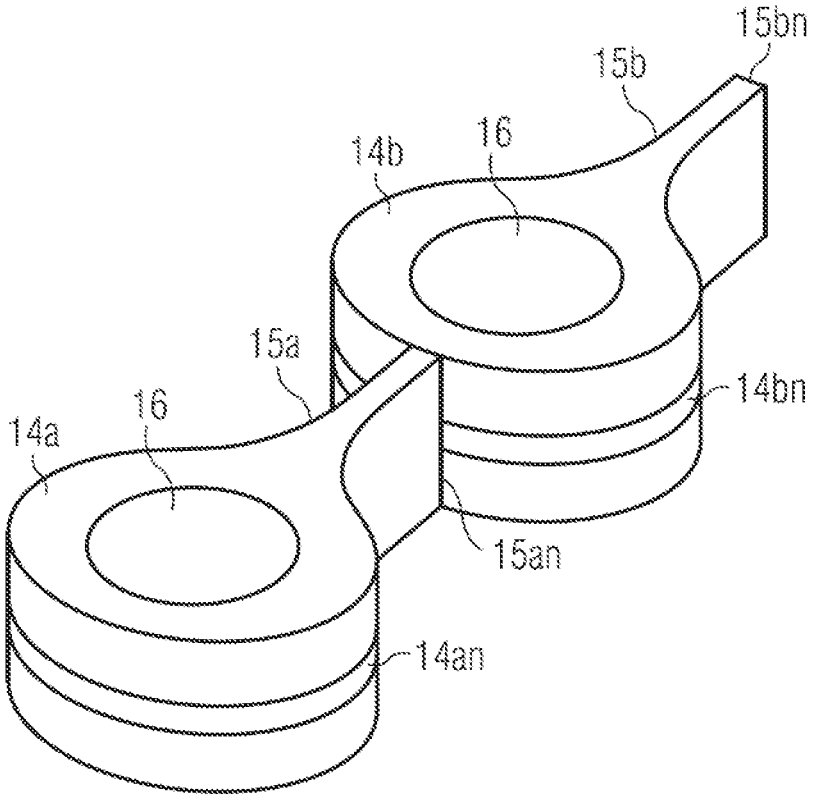
FIGS. 3 and 4 show schematic 3D illustrations of three illumination elements connected in a jointed way, according to extended embodiments.

FIG. 3 shows two illumination elements 14*a* and 14*b* that are connected via the connector 15*a*. This connector 15*a* belongs to the illumination element 14*a* and extends beyond the round base shape of the element 14*a* having embedded therein the illuminant 16. The connector 15*a* has a projection 15*an* configured to be connected to the engagement portion 14*bn* of the base body 14*b*. For example, the engagement portion 14*bn* is a slit into which the projection 15*an* may be introduced and guided in a rotational manner. The exact shape of the engagement portion 14*bn* depends on the respective connection, wherein, as an example, a concave shape can be seen on the basis of the engagement portion 14*bn*.

With reference to the engagement portion/slit 14*an*, it is to be noted that the width of the same, or the angle extending along the circumference of the element 14*a*, is decisive for the extent of the angulation.

Figure 4:
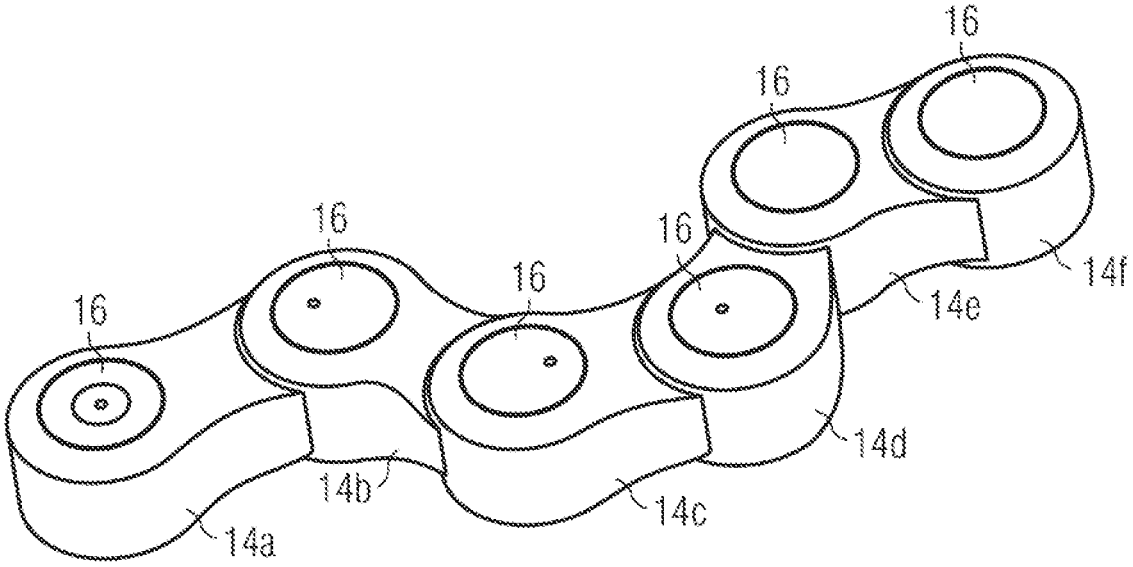

FIG. 4 shows a possible implementation 10' with the illumination elements 14*a*-14*f*. Each illumination element 14*a*-14*f* includes an illuminant 16.

With respect to the illuminants 16, it is to be noted that, according to embodiments, they may be coupled to optics enabling a focusing along the emission direction.

With respect to the current supply, it is to be noted that the above embodiments assumed that the same is integrated into the individual elements, and particularly into the first element 12. According to further embodiments, it is obviously also conceivable that the current supply is provided externally. For example, this is interesting if several illumination chains are to be illuminated by means of one current supply.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

LIST OF REFERENCE NUMERALS

10, 10', 10" illumination chain
12, 12', 12" first illumination element
14*a*-14*c*, 14*a'*, 14*a"* further illumination element
15*a*-15*c* connection element
16 illuminant

The invention claimed is:

1. Illumination chain, comprising:
a first illumination element; and
a multitude of further illumination elements, wherein each further illumination element is connected via a joint to the preceding illumination element;
wherein each illumination element comprises optics configured to emit light in an emission direction; and wherein each illumination element comprises an emission direction, and wherein all emission directions of all illumination elements are orientated equally;
wherein each illumination element comprises LED illuminants;
wherein the joint is realized by a connector belonging to the illumination element and extending beyond a round base shape of the illumination element, in connection with an engagement portion of the further illumination element connected to the illumination element, wherein the LED illuminant is embedded into the round base shape of the illumination element, wherein the engagement portion comprises a slit extending at an angle along a circumference of the round base shape of the illumination element, wherein a projection of the connector is introduced into the slit and is guided rotationally into the slit around the round base shape;
wherein, the joint allow a corresponding angular range between two illumination elements connected by the joint of at least at least 90 degrees or of at least 270 degrees.

2. Illumination chain according to claim 1, wherein each joint comprises a device to carry a current.

3. Illumination chain according to claim 1, wherein the joint is implemented by a joint; or wherein the joint is configured to limit three, four, or five degrees of freedom.

4. Illumination chain according to claim 1, wherein the first illumination element comprises a current supply for the first illumination element and the further illumination elements.

5. Illumination chain according to claim 1, wherein each illumination element comprises electronics and/or a current supply.

6. Illumination chain according to claim 1, wherein the joint comprises a connection device so that the illumination elements connected by the joint are connectable and/or separable.

7. Illumination chain according to claim 1, wherein the first illumination element comprises a connection device and/or a jointed connection device configured to connect the first illumination element to a further illumination element and/or to a further illumination element of a further illumination chain and/or a first illumination element of a further illumination chain.

8. Illumination chain according to claim 7, wherein the connection device or the jointed connection device are configured so that a first illumination element of a further illumination chain is connectable to the first illumination element such that the multitude of the further illumination elements and the multitude of the further illumination elements of the further illumination chain are arranged in parallel.

9. System comprising a first and second illumination chain according to claim 1, connected with each other so as to create a row of the illumination elements of the first and second illumination chains.

10. System comprising a first and a second illumination chain according to claim 1, connected to each other so that the first and the second illumination chains form an illumination surface.

* * * * *